US007116263B2

(12) United States Patent
Hanahara et al.

(10) Patent No.: US 7,116,263 B2
(45) Date of Patent: Oct. 3, 2006

(54) REMOTE CONTROL TRANSMITTER

(75) Inventors: Tetsuro Hanahara, Tsuruga (JP); Masahiro Takahashi, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 281 days.

(21) Appl. No.: 10/919,125

(22) Filed: Aug. 16, 2004

(65) Prior Publication Data

US 2005/0073807 A1 Apr. 7, 2005

(30) Foreign Application Priority Data

Oct. 1, 2003 (JP) ..... 2003-342998

(51) Int. Cl.
*G08C 19/12* (2006.01)

(52) U.S. Cl. ..... 341/176; 174/98; 310/348

(58) Field of Classification Search ..... 341/173, 341/176; 340/825.69; 310/348; 174/98
See application file for complete search history.

(56) References Cited

U.S. PATENT DOCUMENTS 3,612,749 A * 10/1971 Grube et al. ..... 174/98
3,925,693 A * 12/1975 Meister et al. ..... 310/348
4,148,183 A * 4/1979 Murakami ..... 368/159
5,550,545 A * 8/1996 Rydel ..... 341/176
5,903,226 A * 5/1999 Suman et al. ..... 340/825.69
6,777,858 B1 * 8/2004 Bang et al. ..... 310/348

FOREIGN PATENT DOCUMENTS

JP 03-173198 A 7/1991

* cited by examiner

*Primary Examiner*—Albert K. Wong
(74) *Attorney, Agent, or Firm*—RatnerPrestia

(57) ABSTRACT

A remote control signal transmitter. A movable contact section includes a plurality of movable contacts and has elasticity. A wiring substrate has a movable contact section thereon. A crystal oscillator is mounted on the wiring substrate. A control section transmits a remote control signal in accordance with an operation of the movable contact section. In this structure, the movable contact section has a holding section that is abutted with the crystal oscillator.

7 Claims, 4 Drawing Sheets

REMOTE CONTROL TRANSMITTER

FIELD OF THE INVENTION

The present invention relates to a remote control transmitter used for remotely controlling various electronic devices (e.g., TV, video recorder, air conditioner).

BACKGROUND OF THE INVENTION

Recently, various electronic devices (e.g., TV, video recorder, air conditioner) have been diversified and inexpensive. Thus, the remote control transmitter for remotely controlling them has been desired to be inexpensive while providing secure and reliable operation.

A conventional remote control transmitter will be described with reference to FIG. 3 and FIG. 4.

FIG. 3 is a cross-sectional view for explaining the conventional remote control transmitter.

FIG. 4 is an exploded perspective view of the conventional remote control transmitter.

In FIG. 3 and FIG. 4, case 101 has a substantially box shape and is made of insulating resin. Case 101 has, at the upper face thereof, opening hole 101A and a plurality of through holes 101B.

With regards to wiring substrate 102, an upper face and a lower face thereof have a plurality of wiring patterns (not shown). The upper face of wiring substrate 102 has conductive section 102A and a plurality of fixed contacts 102B. Electronic components such as light-emitting diode 106A, microcomputer (hereinafter referred to as MPU) 106B, crystal oscillator 106C or the like are mounted at the upper face of wiring substrate 102. In this way, control circuit 106 for transmitting a remote control signal is provided.

Crystal oscillator 106C, which is used to provide a timer function or to display time, is formed of two thin plates of quartz crystal and a filament for connecting them. Thus, crystal oscillator 106C has a relatively weak structure. In order to prevent breakage due to impact by the dropping or the like, crystal oscillator 106C is bonded to wiring substrate 102 by adhesive agent 107 (e.g., silicone agent).

Display element 103 is formed of liquid crystal or the like. Elastic connection section 104 is provided by layering a conductive layer and insulative layers. A display section of an upper face of display element 103 is exposed from opening hole 1A of case 101. Then, elastic connection section 104 is attached between wiring substrate 102 and display element 103 such that elastic connection section 104 is vertically flexed. In this way, an upper end and a lower end of elastic connection section 104 have an elastic contact with an electrode (not shown) of a lower face of display element 103 and conductive section 102A respectively, thereby allowing conductive section 102A and display element 103 to be electrically connected.

Movable contact section 105 made of material such as rubber is provided on wiring substrate 102 and is housed in case 101. An upper face of movable contact section 105 has a plurality of dome-shaped depressing sections 105B. Depressing sections 105B are upwardly protruded from through holes 101B of case 101.

A lower face of depressing section 105B of movable contact section 105 has movable contact 105A that is opposed to fixed contact 102B of wiring substrate 102 with a predetermined space therebetween.

Furthermore, wiring substrate 102 is fixed to case 101 by a fixation member (e.g., screw). In the manner as described above, a remote control transmitter is configured.

Hereinafter, a case will be described in which a user uses the remote control transmitter having the above configuration to operate an electronic device by, for example, depressing a prescribed depressing section 105B for power source switching, volume control, or another function. Then, an infrared remote control signal corresponding to this operation is transmitted from control circuit 106 to the electronic device. As a result, ON/OFF of the power source, volume control, or another function of the electronic device is provided remotely.

When the user specifies the time at which the electronic device starts or stops its operation or recording, for example, the user depresses a prescribed depressing section 105B to allow display element 103 to display time, thereby specifying the time. Thereafter, the specified time is transmitted as a remote control signal to the electronic device, and the electronic device memorizes the specified time. According to the above procedure, the electronic device starts or stops its operation or recording at the predetermined time.

A remote control transmitter having a display element formed of liquid crystal and having a similar structure as that of the above-described remote control transmitter is disclosed, for example, in Japanese Laid-Open Publication No. 3-173198.

In the above-described conventional remote control transmitter, crystal oscillator 106C used for a timer function, a time display function or the like is fixed via adhesive agent 107 to wiring substrate 102 in order to prevent crystal oscillator 106C from being damaged. Therefore, its assembling (e.g., application or solidification of adhesive agent 107) tends to take time and cause a cost increase of the remote control transmitter.

SUMMARY OF THE INVENTION

A remote control signal transmitter of the present invention is provided in a manner as described below.

A movable contact section includes a plurality of movable contacts and has elasticity.

A wiring substrate has the movable contact section.

A crystal oscillator is mounted on the wiring substrate.

In accordance with the operation of the movable contact section, a control section transmits a remote control signal.

The movable contact section includes a holding section that is abutted with the crystal oscillator.

In the above remote control transmitter, the crystal oscillator is retained by the holding section. This eliminates an operation such as adhesion for retaining the crystal oscillator for example, thereby providing a remote control transmitter that can be assembled in an easy manner.

DESCRIPTION OF THE PREFFERED EMBODIMENTS

Hereinafter, embodiments of the present invention will be described with reference to FIG. 1 and FIG. 2.

Figure 1:
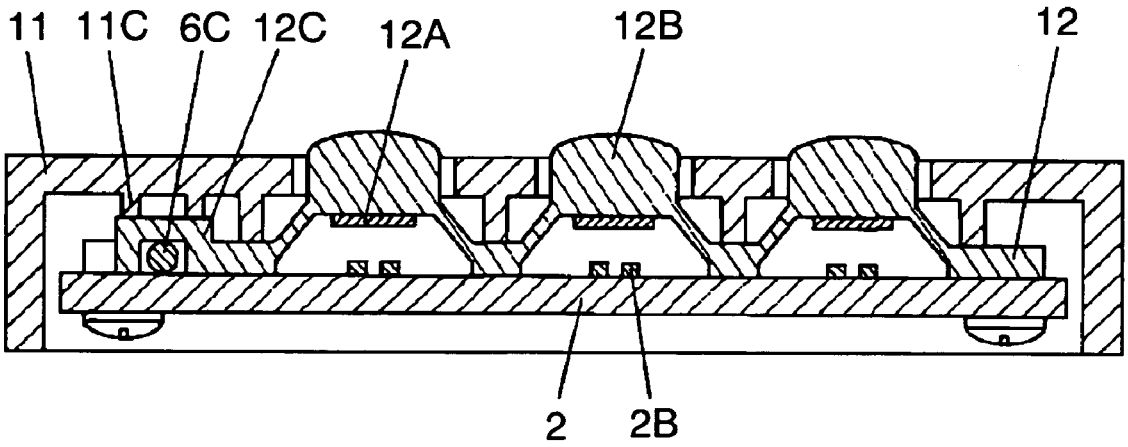
FIG. 1 is a cross-sectional view for explaining a remote control transmitter according to one embodiment of the present invention.

FIG. 1 is a cross-sectional view for explaining a remote control transmitter according to one embodiment of the present invention.

Figure 2:
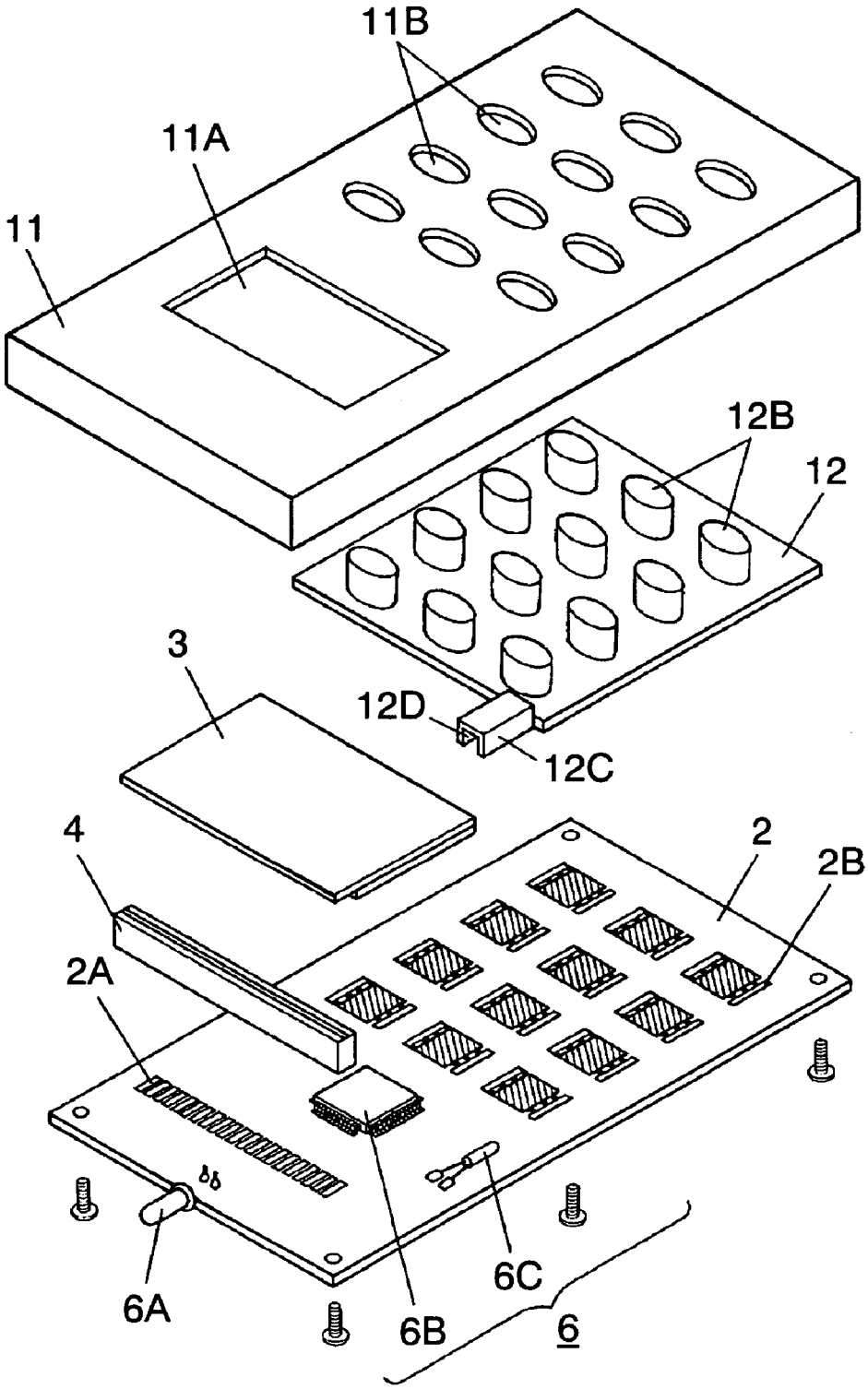
FIG. 2 is an exploded perspective view of the remote control transmitter of the embodiment of the present invention.
Figure 3:
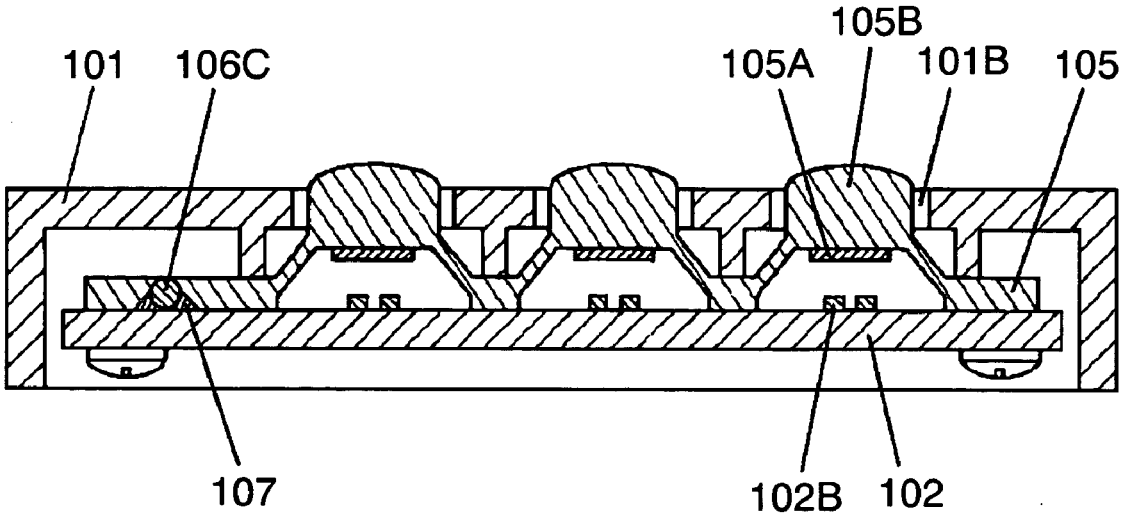
FIG. 3 PRIOR ART
FIG. 3 is a cross-sectional view for explaining a conventional remote control transmitter.
Figure 4:
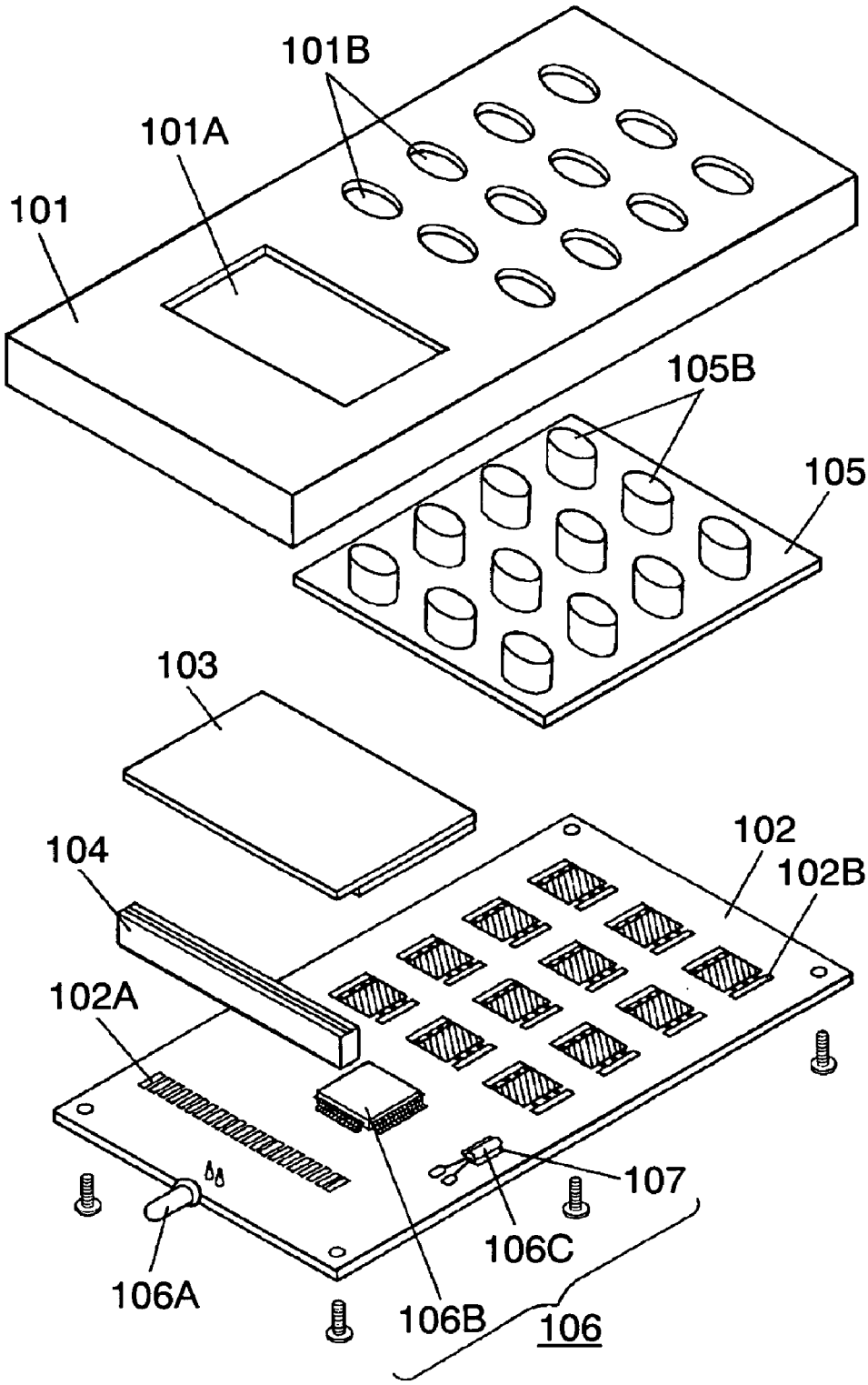
FIG. 4 PRIOR ART
FIG. 4 is an exploded perspective view of the conventional remote control transmitter.

FIG. 2 is an exploded perspective view of the remote control transmitter of the embodiment of the present invention.

In FIG. 1 and FIG. 2, case 11 has a substantially box shape and is made of insulating resin (e.g., polystyrene, ABS). An upper face of case 11 has opening hole 11A and a plurality of through holes 11B.

Wiring substrate 2 is formed of material such as paper phenol or epoxy mixed with glass, and the upper and lower faces thereof have a plurality of wiring patterns (not shown) by copper or the like. The upper face of wiring substrate 2 has conductive section 2A and a plurality of fixed contacts 2B. Furthermore, the upper face of wiring substrate 2 is also mounted with electronic components such as light-emitting diode 6A, microcomputer (hereinafter referred to as MPU) 6B, crystal oscillator 6C. In this manner, control circuit 6 is provided as a controller for transmitting a remote control signal.

Display element 3 is formed of liquid crystal or the like. Elastic connection section 4 is provided by layering a conductive layer (e.g., carbon) and insulative layers (e.g., silicone rubber). An upper face of display element 3 has a display section that is exposed from opening hole 11A of case 11. Then, elastic connection section 4 is attached between wiring substrate 2 and display element 3 such that elastic connection section 4 is somewhat vertically flexed. Upper end and lower end of elastic connection section 4 have an elastic contact with electrodes (not shown) of a lower face of display element 3 and conductive section 2A respectively, thereby allowing conductive section 2A and display element 3 to be electrically connected.

Movable contact section 12 made of elastic material (e.g., silicone rubber, elastomer) is provided on wiring substrate 2 and is housed in case 11. An upper face of movable contact section 12 has a plurality of dome-shaped depressing sections 12B. Depressing sections 12B are upwardly protruded from through holes 11B of case 11.

Furthermore, a lower face of this depressing section 12B of movable contact section 12 has movable contact 12A that is opposed to fixed contact 2B of wiring substrate 2 with a certain space therebetween. An end section of movable contact section 12 has holding section 12C having groove-like inner face 12D for covering crystal oscillator 6C. The inner face 12D is abutted with crystal oscillator 6C. Inner face 12D may be abutted with crystal oscillator 6C at any one of the faces (e.g., upper face thereof) or at a plurality of faces thereof.

Holding section 12C may be made of the same material as that of movable contact section 12 and may be integrated with movable contact section 12.

Alternatively, holding section 12C may be separately provided from movable contact section 12. In this case, holding section 12C may be connected to movable contact section 12 via an adhesion agent or by a joint section consisting of a recessed portion and a protruded portion which are formed at holding section 12C and movable contact section 12, respectively.

When holding section 12C is separately provided from movable contact section 12, holding section 12C may be made of elastic material, particularly the same material as that of movable contact section 12.

Furthermore, wiring substrate 2 is fixed to case 11 by a fixation member (e.g., screw). At the same time, protruded section 11C of a lower face of case 11 provided above holding section 12C depresses holding section 12C, thereby allowing crystal oscillator 6C to have an elastic contact with the upper face of wiring substrate 2.

The remote control transmitter is provided in the manner as described above.

In this way, crystal oscillator 6C, which is formed of thin plates of quartz crystal and a filament, and has a remarkably small strength, is sandwiched between holding section 12C, which is depressed by protruded section 11C, and the upper face of wiring substrate 2. By this structure, this remote control transmitter prevents, when receiving an impact due to the drop or the like, the influence (e.g., damage) by the drop on crystal oscillator 6C.

Because this structure does not use an adhesive agent or the like for fixing crystal oscillator 6C to wiring substrate 2, movable contact section 12 can be provided on wiring substrate 2 by merely covering crystal oscillator 6C by holding section 12C. Therefore, this structure also can reduce the working time.

Hereinafter, a case will be described in which a user uses this remote control transmitter to operate an electronic device by, for example, depressing a prescribed depressing section 12B for power source, volume control, or another function. Then, an infrared remote control signal corresponding to this operation is transmitted from control circuit 6 to the electronic device. As a result, ON/OFF of the power source, volume control, or another function of the electronic device is provided remotely.

In order that the user specifies the time at which the electronic device starts or stops its operation or recording, for example, the user depresses a prescribed depressing section 12B to allow display element 3 to display time, thereby specifying the time. Thereafter, the specified time is transmitted as a remote control signal to the electronic device and the electronic device memorizes the specified time. According to the above procedure, the electronic device starts or stops its operation or recording at the predetermined time.

As described above, in the remote control transmitter of this embodiment, movable contact section 12 having elasticity has holding section 12C that is abutted against crystal oscillator 6C. By using this structure, crystal oscillator 6C does not need to be fixed to wiring substrate 2 by an adhesive agent or the like, thus the inexpensive remote control transmitter that can be assembled in an easy manner can be obtained.

Furthermore, the lower face of case 11 for housing movable contact section 12 and wiring substrate 2 has protruded section 11C that depresses holding section 12C of movable contact section 12. As a result, crystal oscillator 6C can be retained in a securer manner.

The remote control transmitter according to the present invention is easy to be assembled and inexpensive, and thus is useful when used for remotely controlling various electronic devices (e.g., TV, video recorder, air conditioner).

What is claimed is:

1. A remote control signal transmitter, comprising:

a movable contact section including a plurality of movable contacts and having elasticity;

a wiring substrate at which the movable contact section is provided;

a crystal oscillator mounted on the wiring substrate; and a controller for transmitting a remote control signal in accodance with an operation of the movable contact section, wherein the movable contact section includes a holding section that is abutted with the crystal oscillator.

2. The remote control transmitter according to claim 1, further comprising:

a case for housing the movable contact section and the wiring substrate, wherein the case includes a protruded section that depresses the holding section of the movable contact section.

3. The remote control transmitter according to claim 1, wherein the holding section is integrated with the movable contact section.

4. The remote control transmitter according to claim 3, further comprising:

a case for housing the movable contact section and the wiring substrate, wherein the case includes a protruded section that depresses the holding section of the movable contact section.

5. The remote control transmitter according to claim 1, wherein the holding section has an groove-like inner face and at least a part of the inner face is abutted with the crystal oscillator.

6. The remote control transmitter according to claim 5, wherein the holding section is integrated with the movable contact section.

7. The remote control transmitter according to claim 5 further comprising:

a case for housing the movable contact section and the wiring substrate, wherein the case includes a protruded section that depresses the holding section of the movable contact section.

* * * * *